US009118109B2

(12) United States Patent
Oh et al.

(10) Patent No.: US 9,118,109 B2
(45) Date of Patent: Aug. 25, 2015

(54) MULTIBAND ANTENNA WITH GROUNDED ELEMENT

(75) Inventors: Sung-Hoon Oh, Cupertino, CA (US); Thomas Liu, Sunnyvale, CA (US); Thorsten Hertel, San Jose, CA (US)

(73) Assignee: QUALCOMM INCORPORATED, San Diego, CA (US)

( * ) Notice: Subject to any disclaimer, the term of this patent is extended or adjusted under 35 U.S.C. 154(b) by 1123 days.

(21) Appl. No.: 12/971,444

(22) Filed: Dec. 17, 2010

(65) Prior Publication Data

US 2012/0154222 A1 Jun. 21, 2012

(51) Int. Cl.
*H01Q 1/24* (2006.01)
*H01Q 9/42* (2006.01)
*H01Q 5/371* (2015.01)

(52) U.S. Cl.
CPC ..... *H01Q 1/243* (2013.01); *H01Q 5/371* (2015.01); *H01Q 9/42* (2013.01)

(58) Field of Classification Search
CPC ..... H01Q 1/243; H01Q 1/38
USPC ..... 343/702, 700 MS
See application file for complete search history.

(56) References Cited

U.S. PATENT DOCUMENTS

| | | | | |
|---|---|---|---|---|
| 7,602,341 | B2 * | 10/2009 | Wei-Shan et al. | 343/700 MS |
| 2007/0008224 | A1 * | 1/2007 | Chung et al. | 343/700 MS |
| 2007/0030198 | A1 * | 2/2007 | Wei | 343/700 MS |
| 2007/0069958 | A1 | 3/2007 | Ozkar | |
| 2008/0122698 | A1 | 5/2008 | Ollikainen et al. | |
| 2008/0266190 | A1 | 10/2008 | Ohba et al. | |

OTHER PUBLICATIONS

International Search Report and Written Opinion ; mailed Mar. 12, 2012 ; issued in related PCT application PCTIUS2011/061445.

* cited by examiner

*Primary Examiner* — Graham Smith
(74) *Attorney, Agent, or Firm* — Kilpatrick Townsend & Stockton LLP

(57) ABSTRACT

Various embodiments of an antenna structure for mobile devices are described. In one or more embodiments a multiband antenna includes a grounded parasitic element. In some embodiments, a high band arm is provided, and is fed off-center, so that the resonating arms are not symmetrical in length. In some embodiments, a coupled ground resonator is included to add a differential resonating mode. A ground leg may be included to offer facilitate impedance and inductance matching. The combination of these structures creates four distinct resonance modes for the high band, which creases a wide effective bandwidth for the disclosed antenna. Other embodiments are described and claimed.

22 Claims, 11 Drawing Sheets

MULTIBAND ANTENNA WITH GROUNDED ELEMENT

BACKGROUND

A mobile computing device such as a combination handheld computer and mobile telephone or smart phone generally may provide voice and data communications functionality, as well as computing and processing capabilities. Such mobile computing devices rely on antenna designs that are severely constrained by space, volume and other mechanical limitations. Such constraints result in less than desired performance. Accordingly, there may be a need for an improved antenna for use with mobile computing devices. Such an improved antenna should provide good efficiency and gain patterns and should fit within space, volume and mechanical constraints associated with modern handset architectures. The improved antenna should be a simple and low-profile structure for mobile handsets, and should enable wide band frequency response and a unique antenna pattern without compromising antenna size or efficiency.

DETAILED DESCRIPTION

Current and next-generation wireless mobile devices use wide-band and multi-band antennas. Due to fundamental gain-bandwidth limitations of antennas of limited size, however, antenna structure poses a limit to ever shrinking and ever complicated mobile device designs. Moreover, when designing antennas for mobile devices, avoiding complicated antenna structures may be desirable in order to reduce engineering costs, cycle times, and product reliability issues. To address these issues, a multi-band antenna is disclosed having a simple, low-profile structure for use in mobile devices. The antenna enables wide band frequency response without compromising antenna size and system efficiency.

Various embodiments are directed to a multi-band antenna with a grounded element. In some embodiments, a high band arm is provided, and is fed off-center so that the resonating arms are not symmetrical in length. In some embodiments, a coupled ground resonator is included to add a differential resonating mode. A ground leg may be included to facilitate impedance and inductance matching. The combination of these structures creates four distinct resonance modes for the high band, which results in a wide effective bandwidth for the disclosed antenna.

Embodiments may provide a multi-band antenna having a first resonating element, a ground conductor, an electrical signal feed coupled to the first resonating element and the ground conductor, a second resonating element coupled to the first resonating element, and a third resonating element coupled to the ground conductor. In some embodiments, the second resonating element has a first portion and a second portion, the first portion positioned between the first resonating element and a first end of the second resonating element, and the second portion positioned between the first resonating element and a second end of the second resonating element. In some embodiments, the first portion and the second portion may be of unequal length.

Numerous specific details have been set forth herein to provide a thorough understanding of the embodiments. It will be understood by those skilled in the art, however, that the embodiments may be practiced without these specific details. In other instances, well-known operations, components and circuits have not been described in detail so as not to obscure the embodiments. It can be appreciated that the specific structural and functional details disclosed herein may be representative and do not necessarily limit the scope of the embodiments.

It is also worthy to note that any reference to "one embodiment" or "an embodiment" means that a particular feature, structure, or characteristic described in connection with the embodiment is included in at least one embodiment. The appearances of the phrase "in one embodiment" in various places in the specification are not necessarily all referring to the same embodiment.

Figure 2:
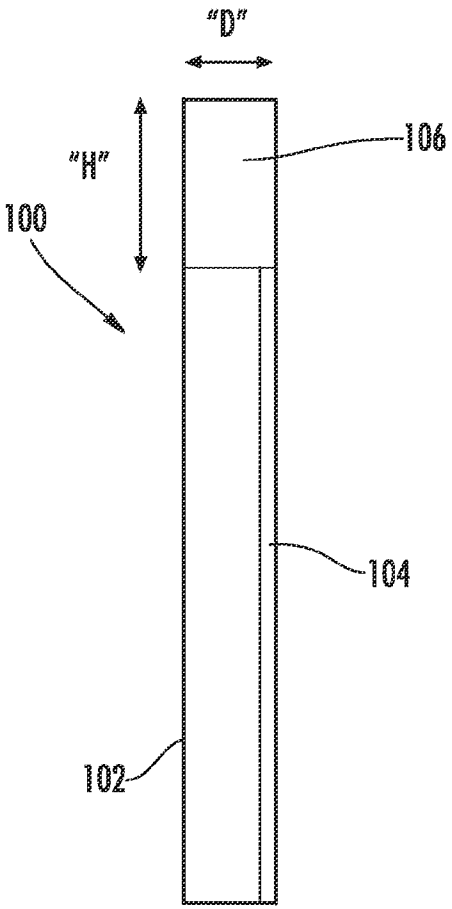
FIGS. 1 and 2 illustrate a mobile computing device in accordance with one or more embodiments.
Figure 1:
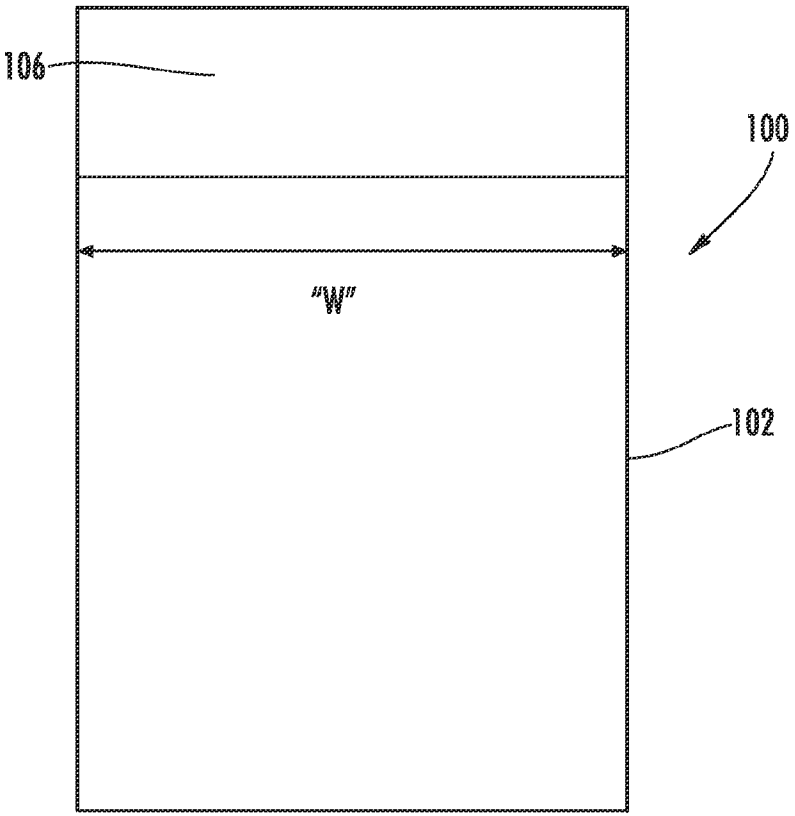

FIGS. 1 and 2 illustrate an embodiment of a wireless device 100 with an internal antenna architecture. The wireless device 100 may comprise, or be implemented as, a handheld computer, mobile telephone, personal digital assistant (PDA), combination cellular telephone/PDA, data transmission device, one-way pager, two-way pager, and so forth. Although some embodiments may be described with wireless device 100 implemented as a handheld computer by way of example, it may be appreciated that other embodiments may be implemented using other wireless handheld devices as well.

In various embodiments, the wireless device 100 may comprise a housing 102 and a printed circuit board (PCB) 104. The housing 102 may include one or more materials such as plastic, metal, ceramic, glass, and so forth, suitable for enclosing and protecting the internal components of the wireless device 100. The PCB 104 may comprise materials such as FR4, Rogers R04003, and/or Roger RT/Duroid, for example, and may include one or more conductive traces, via structures, and/or laminates. The PCB 104 also may include a finish such as Gold, Nickel, Tin, or Lead. In various implementations, the PCB 104 may be fabricated using processes such as etching, bonding, drilling, and plating.

The device 100 may include a "keep-out" area 106 at or near one end of the housing 102. The keep-out area 106 comprises a region of the device housing 102 that the PCB does not occupy. In the illustrated embodiment, however, the "keep-out" area 106 houses the disclosed antenna structure 108 (see, e.g., FIG. 3). As will be discussed in greater detail later, the size and arrangement of the disclosed antenna structure 108 is constrained by the size of the keep-out area 106, and thus it is desirable that the antenna structure 108 provide a desired performance in as small a form factor as can be accommodated.

In various embodiments, a wireless device 100 may comprise elements such as a display, an input/output (I/O) device, a processor, a memory, and a transceiver, for example. One or more elements may be implemented using one or more circuits, components, registers, processors, software subroutines, modules, or any combination thereof, as desired for a given set of design or performance constraints.

The display may be implemented using any type of visual interface such as a liquid crystal display (LCD), a touch-sensitive display screen, and so forth. The I/O device may be implemented, for example, using an alphanumeric keyboard, a numeric keypad, a touch pad, input keys, buttons, switches, rocker switches, a stylus, and so forth. The embodiments are not limited in this context.

The processor may be implemented using any processor or logic device, such as a complex instruction set computer (CISC) microprocessor, a reduced instruction set computing (RISC) microprocessor, a very long instruction word (VLIW) microprocessor, a processor implementing a combination of instruction sets, or other processor device. In some embodiments, for example, the processor may be implemented as a general purpose processor, such as a processor made by Intel® Corporation, Santa Clara, Calif. The processor also may be implemented as a dedicated processor, such as a controller, microcontroller, embedded processor, a digital signal processor (DSP), a network processor, a media processor, an input/output (I/O) processor, a media access control (MAC) processor, a radio baseband processor, a field programmable gate array (FPGA), a programmable logic device (PLD), and so forth. The embodiments, however, are not limited in this context.

The memory may be implemented using any machine-readable or computer-readable media capable of storing data, including both volatile and non-volatile memory. The memory may be non-transient computer-readable media (e.g., memory or storage). Memory may include read-only memory (ROM), random-access memory (RAM), dynamic RAM (DRAM), Double-Data-Rate DRAM (DDRAM), synchronous DRAM (SDRAM), static RAM (SRAM), programmable ROM (PROM), erasable programmable ROM (EPROM), electrically erasable programmable ROM (EEPROM), flash memory, polymer memory such as ferroelectric polymer memory, ovonic memory, phase change or ferroelectric memory, silicon-oxide-nitride-oxide-silicon (SONOS) memory, magnetic or optical cards, or any other type of media suitable for storing information. It is worthy to note that some portion or all of memory may be included on the same integrated circuit as a processor, or alternatively some portion or all of memory may be disposed on an integrated circuit or other medium, for example a hard disk drive, that is external to the integrated circuit of a processor. The embodiments are not limited in this context.

The transceiver may be implemented, for example, by any transceiver suitable for operating at a given set of operating frequencies and wireless protocols for a particular wireless system. For example, the transceiver may be a two-way radio transceiver arranged to operate in the 824-894 MHz frequency band (GSM), the 1850-1990 MHz frequency band (PCS), the 1575 MHz frequency band (GPS), the 824-894 MHz frequency band (NAMPS), the 1710-2170 MHz frequency band (WCDMA/UMTS), or other frequency bands.

In various embodiments, an antenna may be electrically connected to a transceiver operatively associated with a signal processing circuit or processor positioned on a PCB. In order to increase power transfer, the transceiver may be interconnected to an antenna such that respective impedances are substantially matched or electrically tuned to compensate for undesired antenna impedance. In some cases, the transceiver may be implemented as part of a chip set associated with a processor. The embodiments are not limited in this context.

Figure 3:
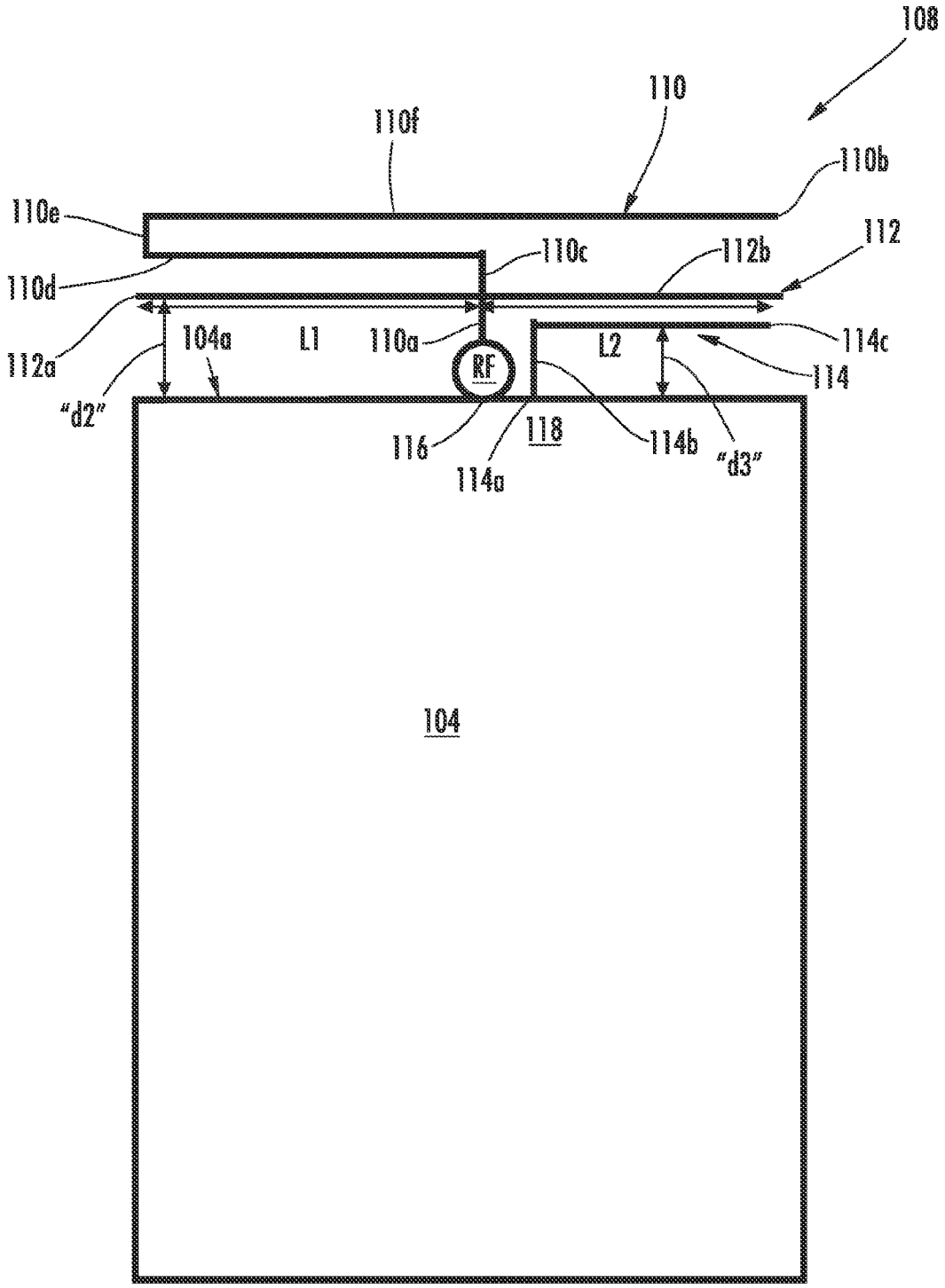
FIG. 3 illustrates a position of an antenna element with respect to a PCB board according to one or more embodiments.

Referring now to FIG. 3, PCB 104 and antenna structure 108 of device 100 are shown in adjacent relation. The antenna structure may 108 may include a plurality of resonating elements, or "arms" which in operation may resonate at different frequencies to provide a desired bandwidth. In the illustrated embodiment, the antenna structure 108 comprises a first resonating element 110, which may be referred to as a "lowband arm." A second resonating element 112, which may be referred to as a "highband arm" may be positioned adjacent to the first resonating element, in generally parallel spaced relation. A third resonating element 114, which may be referred to as a "coupled ground resonator" may be positioned adjacent the first resonating element 110.

The first resonating element 110 may have a first end 110*a* that is electrically coupled to an electrical feed structure 116 associated with the PCB 104. The feed structure 116 may be a coaxial cable, microstrip line slot line, coplanar waveguide, parallel transmission line, or the like. As will be described in greater detail later, the feed structure 116 may be coupled to an impedance matching circuit which, in turn, may be coupled to an associated transceiver.

The first resonating element 110 may have a free end 110*b* located opposite the first end 110*a*. Between the first end 110*a* and the free end 110*b* the first resonating element 110 may include a first section 110*c* oriented perpendicular to the PCB 104, a second section 110*d* oriented parallel to a top edge 104*a* of the PCB 104, a third section 110*e* oriented perpendicular to the PCB 104, and a fourth section 110*f* oriented parallel to the top edge 104*a* of the PCB. It will be appreciated that the actual spacings between these sections will depend at least in part upon how the structure is tuned. This arrangement provides the first resonating element 110 with a desired overall length, and also positions the first resonating element 110 with respect to the other resonating elements of the antenna structure 108 to obtain one or more desired resonances. It will be appreciated that the illustrated arrangement is exemplary, and that other arrangements of the first resonating element 110 can also be used.

The second resonating element 112 may be oriented generally parallel to the top edge 104*a* of the PCB 104, and may be spaced a distance "d2" therefrom. In one embodiment, the distance "d2" is maintained as large as practical to provide a desired offset from the top edge 104*a* of the PCB, while also maintaining the structure within the confines of the keepout area 106. The second resonating element 112 may be electrically coupled to the first section 110*c* of the first resonating element 110. This coupling arrangement may split the second resonating element 112 into first and second sections 112*a*, 112*b* having respective lengths L1 and L2. In some embodiments, L1 and L2 are unequal.

In an exemplary embodiment, the length L1 of the first section 112*a* is greater than the length L2 of the second section 112*b*, and the first section 112*a* may be positioned adjacent to the second section 110*d* of the first resonating element 110. As will be described in greater detail, this arrangement may result in the second resonating element producing two separate resonances in operation, which may provide the antenna structure 108 with a wider bandwidth as compared to prior designs.

The third resonating element 114 may have a first end 114*a* coupled to a ground plane portion 118 of the PCB 104, which "shorts" the third resonating element 114 to ground. In the illustrated embodiment, the third resonating element 114 may have a first section 114*b* oriented perpendicular to the top edge 104*a* of the PCB. A second section 114*c* may be oriented parallel to the top edge 104*a* of the PCB, and may be spaced a distance "d3" therefrom. In one embodiment the distance "d3" is maintained as large as practical while also maintaining the element 114 within the limited confines of the keepout area 106. Thus arranged, the second section 114*b* may be positioned adjacent to the second section 112*b* of the second resonating element 112. This arrangement may cause the second and third resonating elements 112, 114 to produce an additional resonance in operation, which, again, may provide the antenna structure 108 with a wider bandwidth as compared to prior designs.

As noted, the second resonating element 112 may have first and second sections that are different lengths (i.e., L1><L2). In the illustrated embodiment, L1 is shown as being greater than L2. It will be appreciated, however, that some embodiments may include an arrangement of the second resonating element 112 in which L2 is greater than L1.

Figure 4:
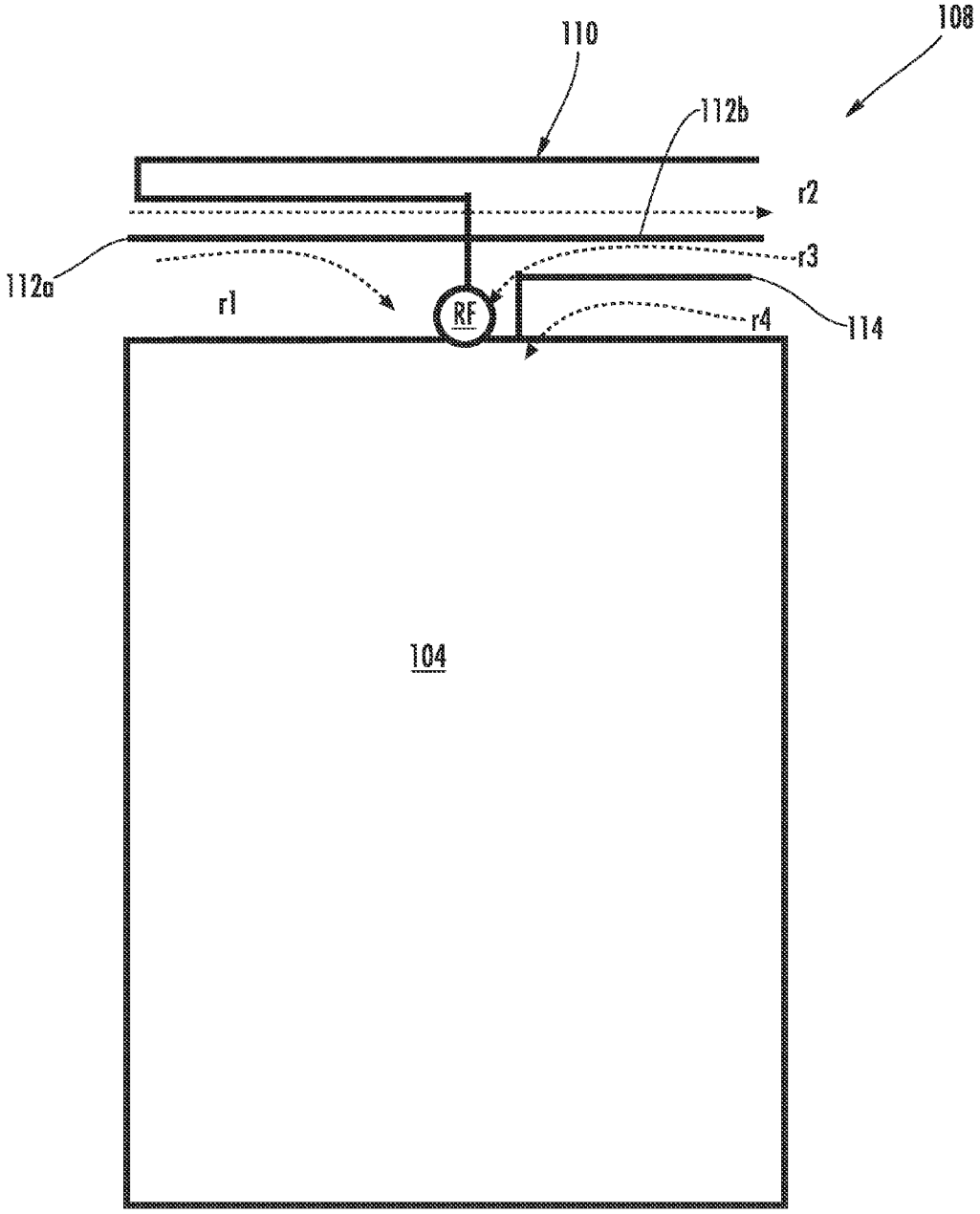
FIG. 4 illustrates a position of an antenna element with respect to a PCB board according to one or more embodiments.

Referring now to FIG. 4, the disclosed arrangement may provide four individual resonances (R1, R2, R3 and R4). The first resonance may be produced by the first section 112*a* of the second resonating element 112 (i.e., for embodiments in which the L1 is greater than L2). In one embodiment, this first resonance may be about 1.7 GHz. The second resonance may be produced by the entire length (L1+L2) of the second resonating element 112 in a manner similar to that of a dipole antenna. In one embodiment, this second resonance may be about 1.9 GHz. The third resonance may be produced by the second section 112*b* of the second resonating element 112 (i.e., for the embodiment in which L1 is greater than L2). In one embodiment, this third resonance may be about 2.2 GHz. The fourth resonance may be produced by the second resonating element 112 coupled with the third resonating element 114. In one embodiment, this fourth resonance may be about 2.9 GHz. It will be appreciated that these resonance values are merely exemplary, and that other resonance values may apply, depending upon how the device is tuned.

Thus, some embodiments of the above-described arrangement of resonating elements may provide the antenna structure 108 with an operational range of from about 1.7 GHz to about 2.9 GHz. It will be appreciated, however, that the resonating elements 110, 112 and 114 can be provided in different sizes, shapes and arrangements to result in other desired resonance values.

Figure 5:
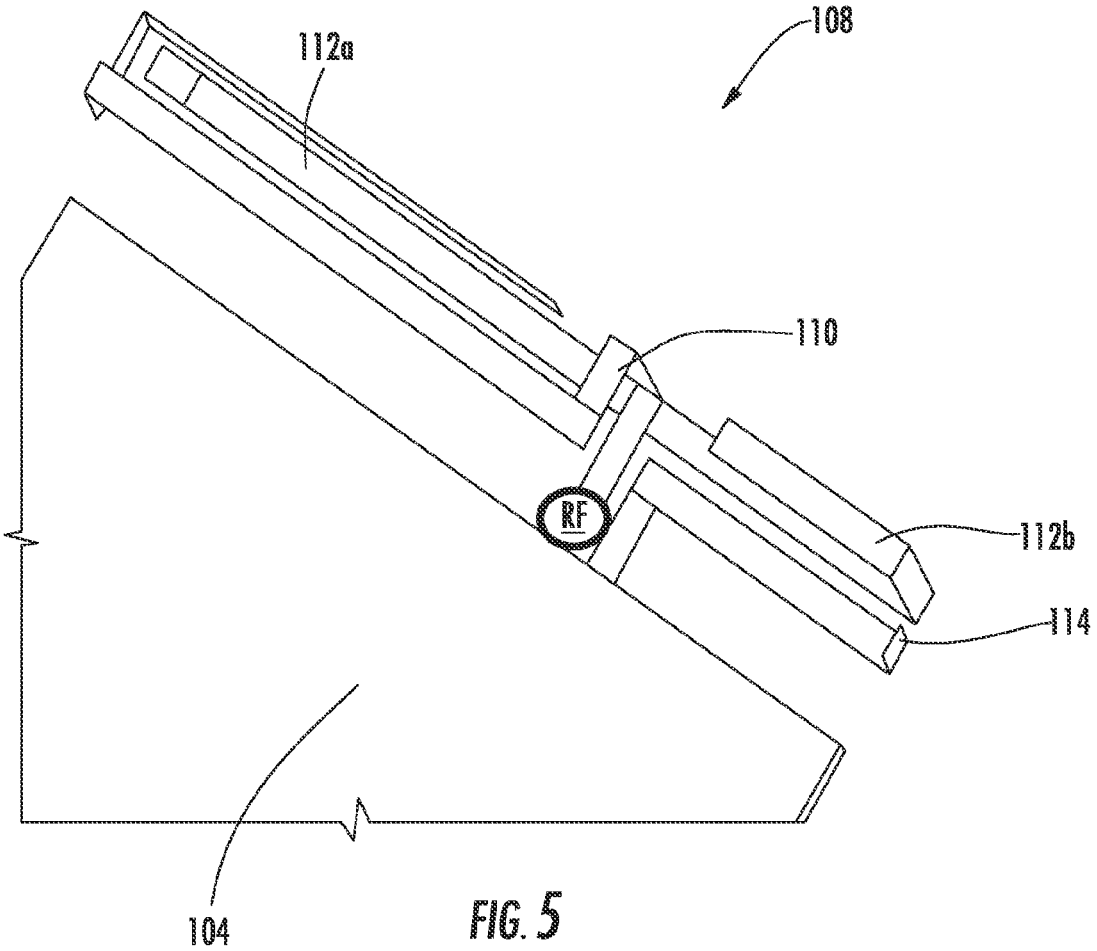
FIG. 5 is an isometric view of a position of an antenna element with respect to a PCB board according to one or more embodiments.

As previously noted, the disclosed antenna structure 108 may lend itself to implementation in the small volume keep-out area 106 of mobile device 100. FIG. 5 shows such an exemplary implementation in which the resonating elements 110, 112, 114 are shown in isometric relation to each other. As can be seen, the first and second resonating elements 110, 112 embody a "folded" configuration so that they may fit within the keep-out area 106, while still retaining a desired relationship to produce the aforementioned multiple resonances. As shown, the first resonating element 110 incorporates a plurality of bends that wrap around the first section 112*a* of the second resonating element 112. The second section 112*b* of the second resonating element 112 similarly includes a plurality of bends that provide the section with a "u-shaped" or "j-shaped" appearance. This three-dimensional wrapping of the antenna structure 108 enable it to fit within a limited volume, but does not substantially affect performance of the structure nor does it affect the frequencies at which the individual arms resonate.

Thus, arranged, the disclosed antenna structure 108 may fit within a reduced keep-out area 106 associated with modern low-profile mobile devices. In one embodiment, the disclosed antenna structure 108 may fit within a keep-out area 106 having dimensions of about 60 millimeters (mm) wide ("W"), about 10 mm high ("H"), and about 7 mm deep ("D") (see FIGS. 1 and 2). Prior devices often employ a keep-out area that can be up to 15 mm high and 12 mm deep.

Figure 6:
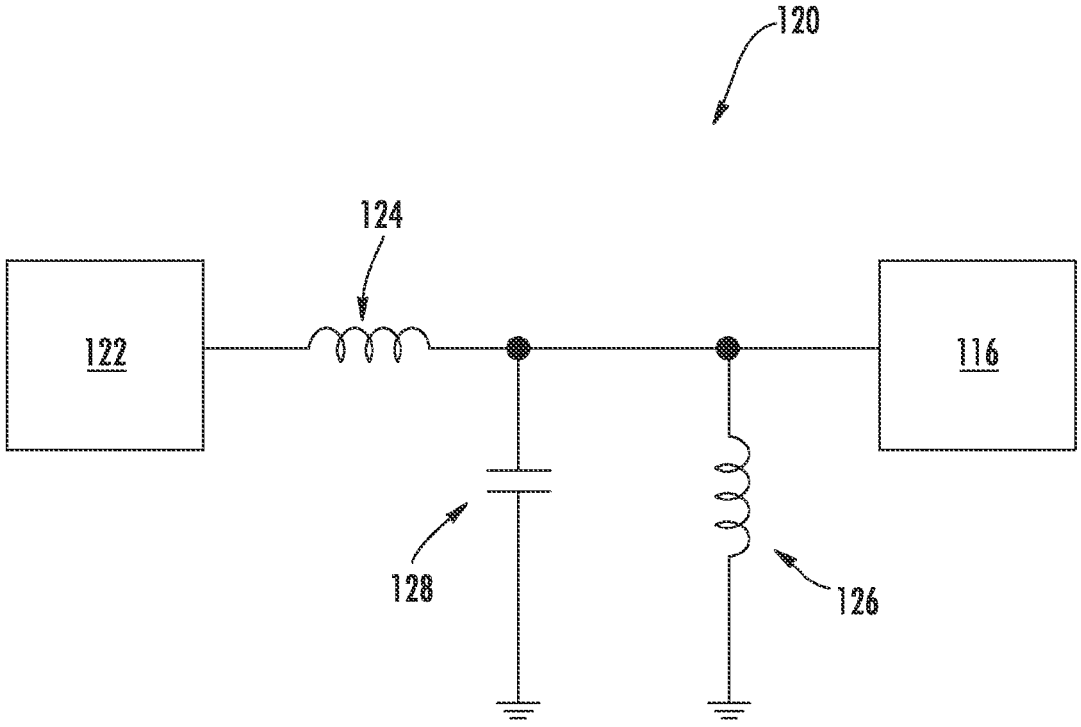
FIG. 6 illustrates a matching circuit in accordance with one or more embodiments.

FIG. 6 shows an exemplary matching circuit 120 for use with the antenna structure of FIGS. 3-5. The matching circuit 120 may couple the feed structure 116 to an output from a transceiver 122, and may include components useful for matching the impedance of the transceiver to the impedance of the antenna over a wide frequency range. In some embodiments, the matching circuit 120 may include first and second inductors 124, 126 and a capacitor 128. In the illustrated embodiment, the feed structure is coupled in series with the first inductor 124, and is coupled in parallel with the second inductor 126 and the capacitor 128. In one non-limiting exemplary embodiment, the first and second inductors 124, 126 may have respective inductances of 2 nanoHenrys (nH) and 7 nH, while the capacitor 128 has a capacitance of 2 picoFarads (pF). It will be appreciated that this is but one exemplary implementation of a matching circuit 120 for the antenna structure 108, and others may also be used.

Figure 7:
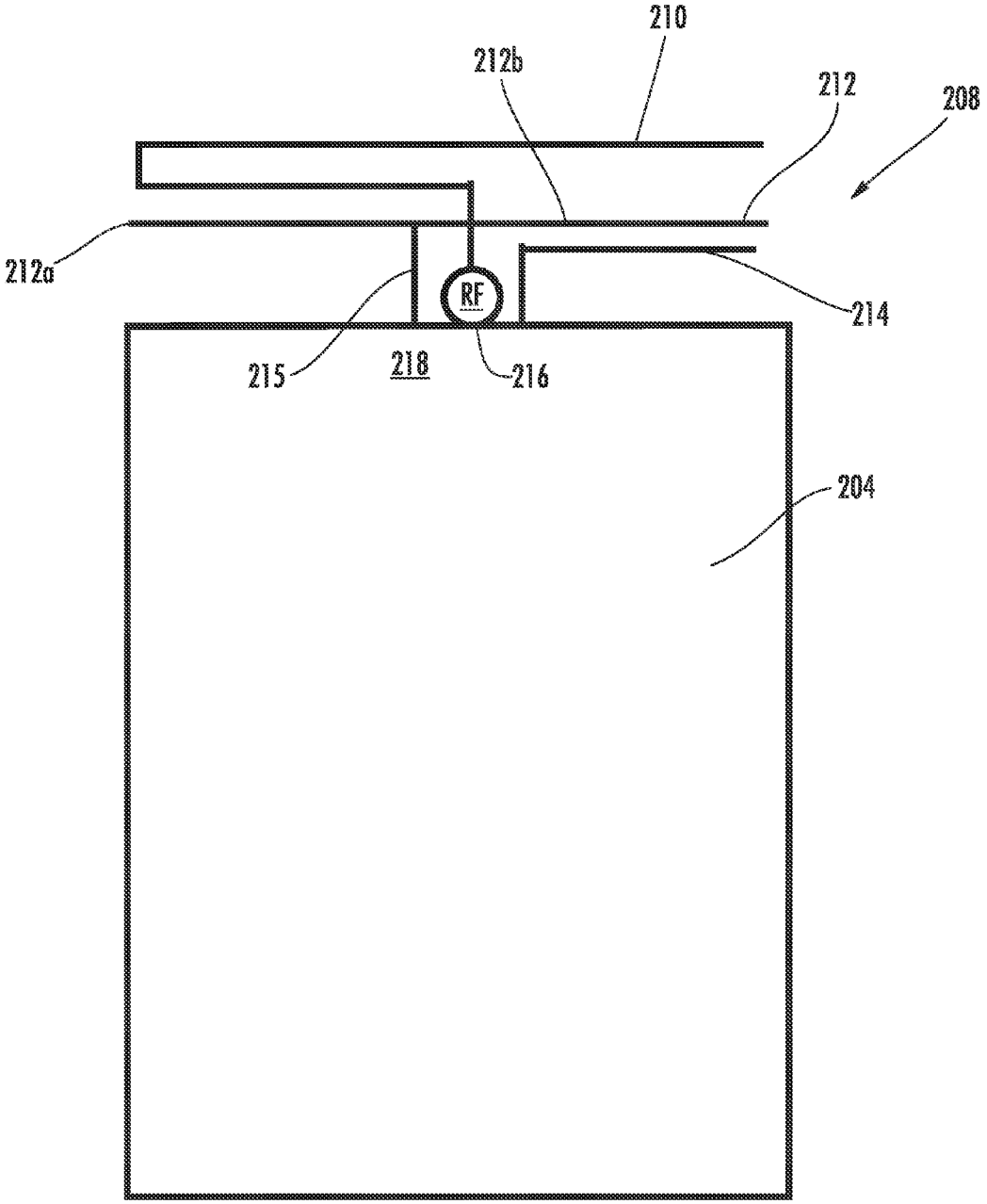
FIG. 7 illustrates a position of an antenna element with respect to a PCB board according to one or more embodiments.

Referring now to FIG. 7, an embodiment of a PCB 204 and antenna structure 208 for use in device 100 are shown. The antenna structure 208 may include first, second and third resonating elements 210, 212 and 214 configured and arranged in the manner described in relation to the embodiment of FIGS. 3-5 (including, for example, a second resonating element 212 having legs L1, L2 of unequal length). Thus, the details and arrangement of the first, second and third resonating elements 208, 210 and 212 may be obtained by reference to the description of the prior embodiment, and will not be reiterated here.

The disclosed antenna structure 208 differs from the prior embodiment in that a ground leg 215 is coupled between the second resonating element 212 and the ground plane 218. In some embodiments, the ground leg 215 is coupled to the first section 212*a* of the second resonating element 212 (where the first section 212*a* is longer than the second section 212*b*). As arranged, the ground leg 215 serves to ground the second resonating element 212. Because the first resonating element is coupled to the second resonating element 212, the ground leg 215 also serves to ground the first resonating element.

Providing the antenna structure 208 with a ground leg 215 results in better impedance matching for the feed structure 216 as compared to designs that have no such ground leg. As such, a simplified impedance matching circuit may be used to obtain a desired matching of the antenna 208 and transceiver.

As with the embodiment described in relation to FIGS. 3-5, the antenna structure 208 may result in four individual resonances (R1, R2, R3 and R4). The first resonance may be produced by the first section 212*a* of the second resonating element 212 (i.e., for the embodiment in which the L1 is greater than L2). In one embodiment, this first resonance may be about 1.7 GHz. The second resonance may be produced by the entire length (L1+L2) of the second resonating element 212 in a manner similar to that of a dipole antenna. In one embodiment, this second resonance may be about 1.9 GHz. The third resonance may be produced by the second section 212*b* of the second resonating element 212 (i.e., for the embodiment in which L1 is greater than L2). In one embodiment, this third resonance may be about 2.2 GHz. The fourth resonance may be produced by the second resonating element 212 coupled with the third resonating element 214. In one embodiment, this fourth resonance may be about 2.9 GHz. It will be appreciated that these resonance values are merely exemplary, and that other resonance values may apply, depending upon how the device is tuned.

As arranged, the resonating elements may result in an antenna structure 208 have an operational range of from about 1.7 GHz to about 2.9 GHz. It will be appreciated, however, that the resonating elements 210, 212 and 214 can be provided in different sizes, shapes and arrangements to result in other desired resonance values.

Figure 8:
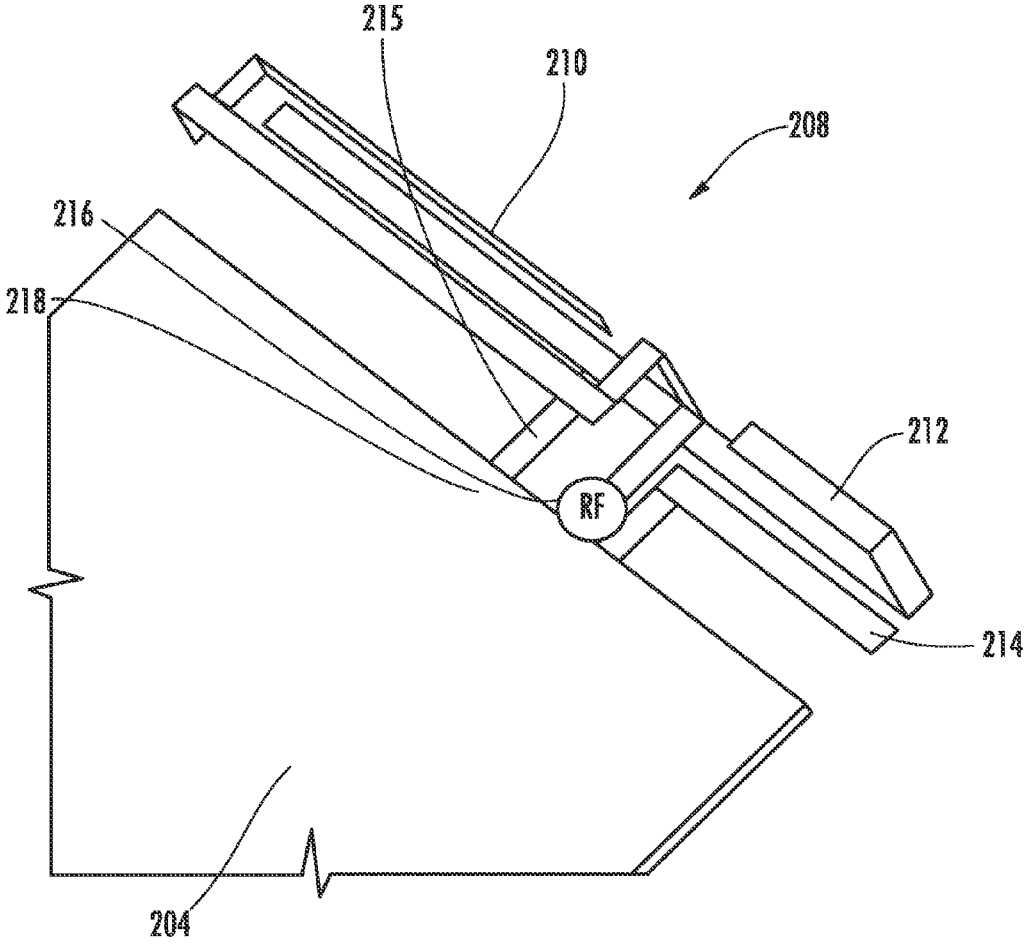
FIG. 8 is an isometric view of a position of an antenna element with respect to a PCB board according to one or more embodiments.

As with the previous embodiment, the disclosed antenna structure 208 may be implemented in the small volume "keep out" area 106 of mobile device 100. FIG. 8 shows such an exemplary implementation in which the resonating elements 210, 212, 214 and the ground leg 215 are shown in isometric relation to each other. The first and second resonating elements 210, 212 are shown in a "folded" configuration to enable them to fit within the "keep out" area 206. Thus, arranged, the disclosed antenna structure 208 may fit within a reduced keepout area 106 associated with modern low-profile mobile devices. In one embodiment, the disclosed antenna structure 108 may fit within a keepout area 106 having dimensions of about 60 millimeters (mm) wide ("W"), about 10 mm high ("H"), and about 7 mm deep ("D") (see FIGS. 1 and 2).

Figure 9:
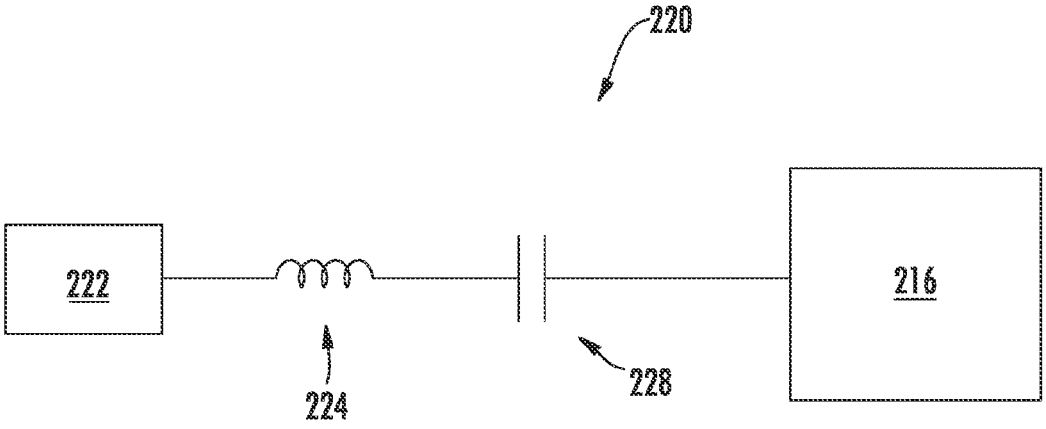
FIG. 9 illustrates a matching circuit in accordance with one or more embodiments.

FIG. 9 shows an exemplary matching circuit 220 for use with the antenna structure of FIGS. 7-8. The matching circuit 220 may couple the feed structure 216 to the output from a transceiver 222. The matching circuit 220 may include an inductor 224 and a capacitor 228. In the illustrated embodiment, the feed structure 216 is coupled in series with the inductor 224 and the capacitor 228. In one non-limiting exemplary embodiment, the inductor 224 has an inductance of 1.8 nH while the capacitor 228 has a capacitance of 1.6 pF. It will be appreciated that this is but one exemplary implementation of a matching circuit for the antenna structure 108, and others may also be used.

Figure 10:
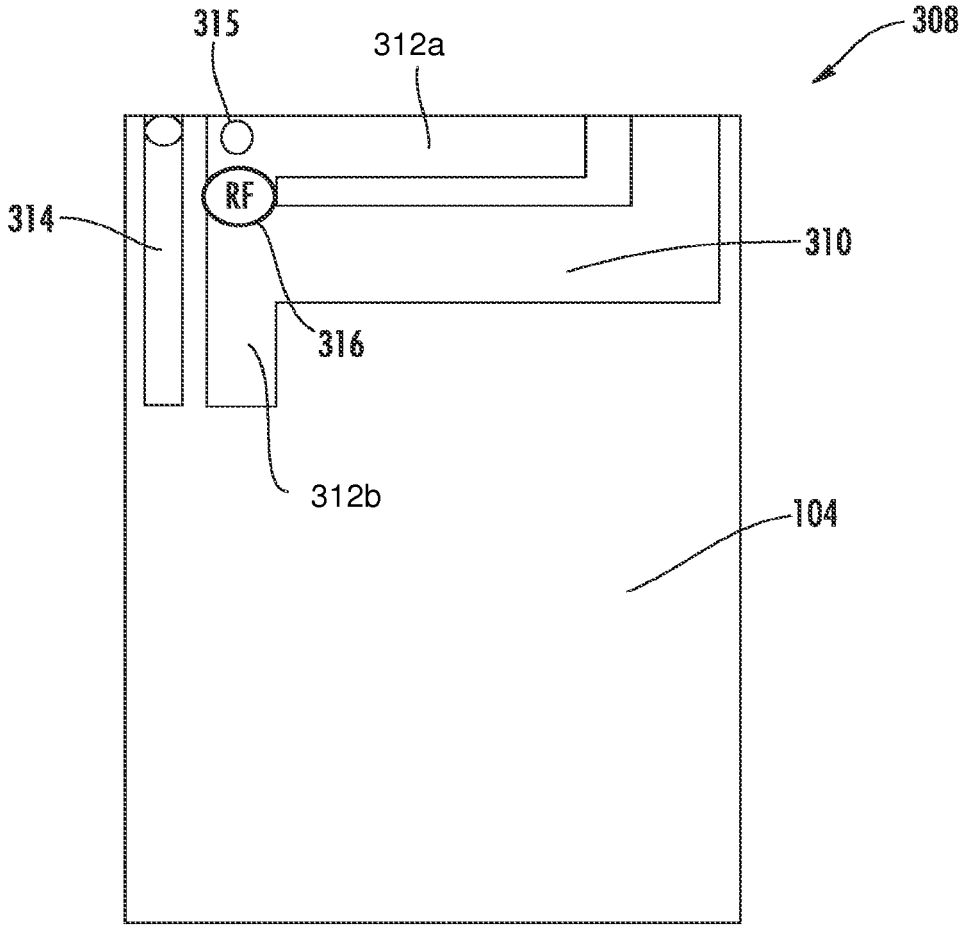
FIG. 10 illustrates a position of an antenna element on a PCB board according to one or more embodiments.

FIG. 10 shows the disclosed antenna structure 308 implemented as an on-ground (i.e., planar inverted F antenna ("PIFA")) type antenna structure. Thus, antenna structure 308 includes first, second and third resonating elements 310, 312, 314 configured and arranged in the same manner as similar elements described in relation to the previous embodiments. Antenna structure 308 also includes a ground leg 315 coupled to the second resonating element 312 in the same or similar manner as described in relation to the embodiment illustrated in FIGS. 7 and 8. Feed structure 316 is also shown. The elements of antenna structure 308 are similar those described in relation to the previous embodiments, and thus the details of their operation will not be reiterated here.

Figure 11:
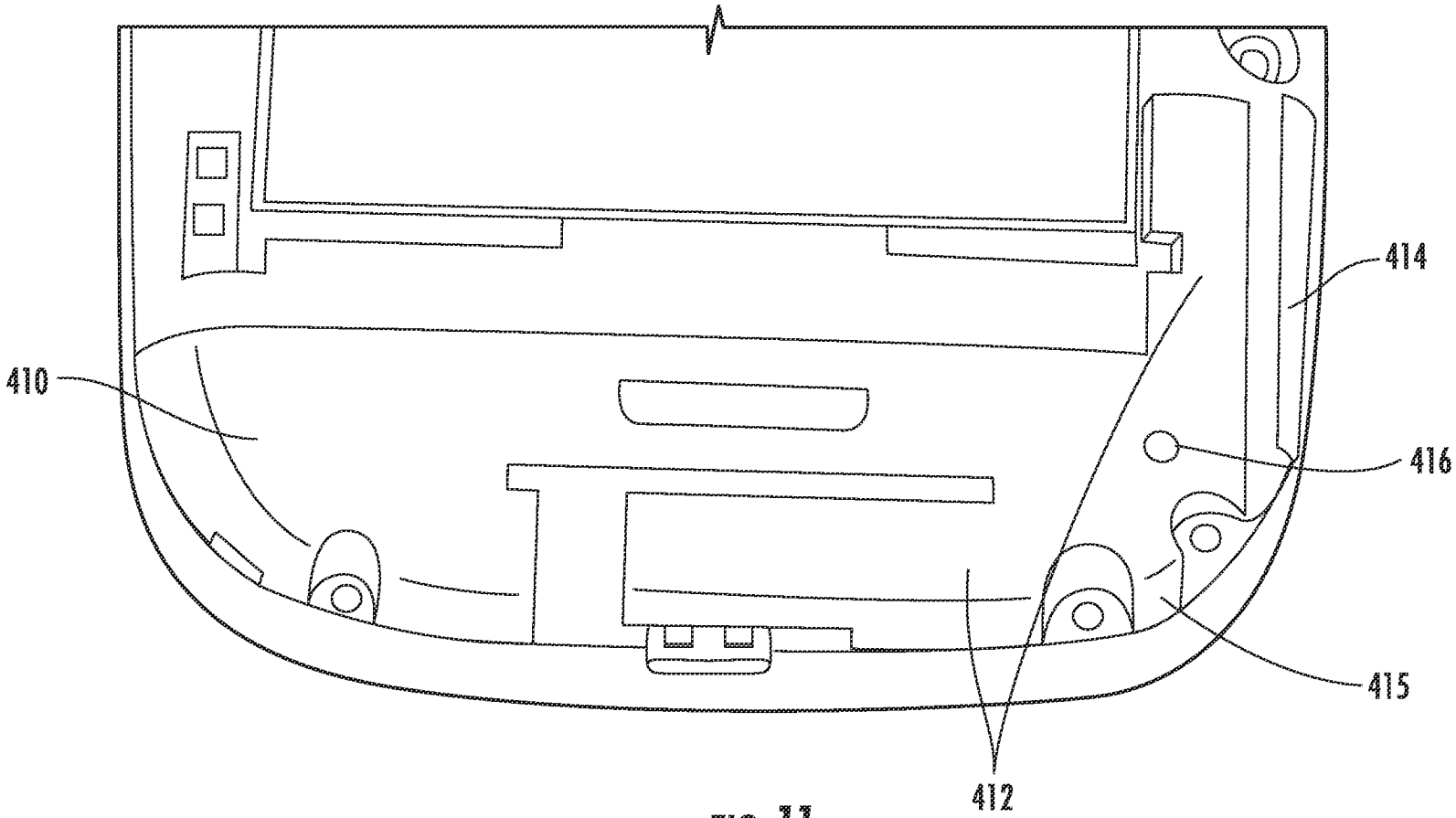
FIG. 11 illustrates a position of an antenna element with respect to an exemplary device according to one or more embodiments.

FIG. 11 shows an exemplary implementation of the disclosed antenna structure 408 implemented in a device 100. Thus, antenna structure 408 includes first, second and third resonating elements 410, 412, 414, ground leg 415 and feed structure 416. These elements are configured and arranged in the same manner as similar elements described in relation to the previous embodiments, and thus, the details of their operation will not be reiterated here.

Figure 12:
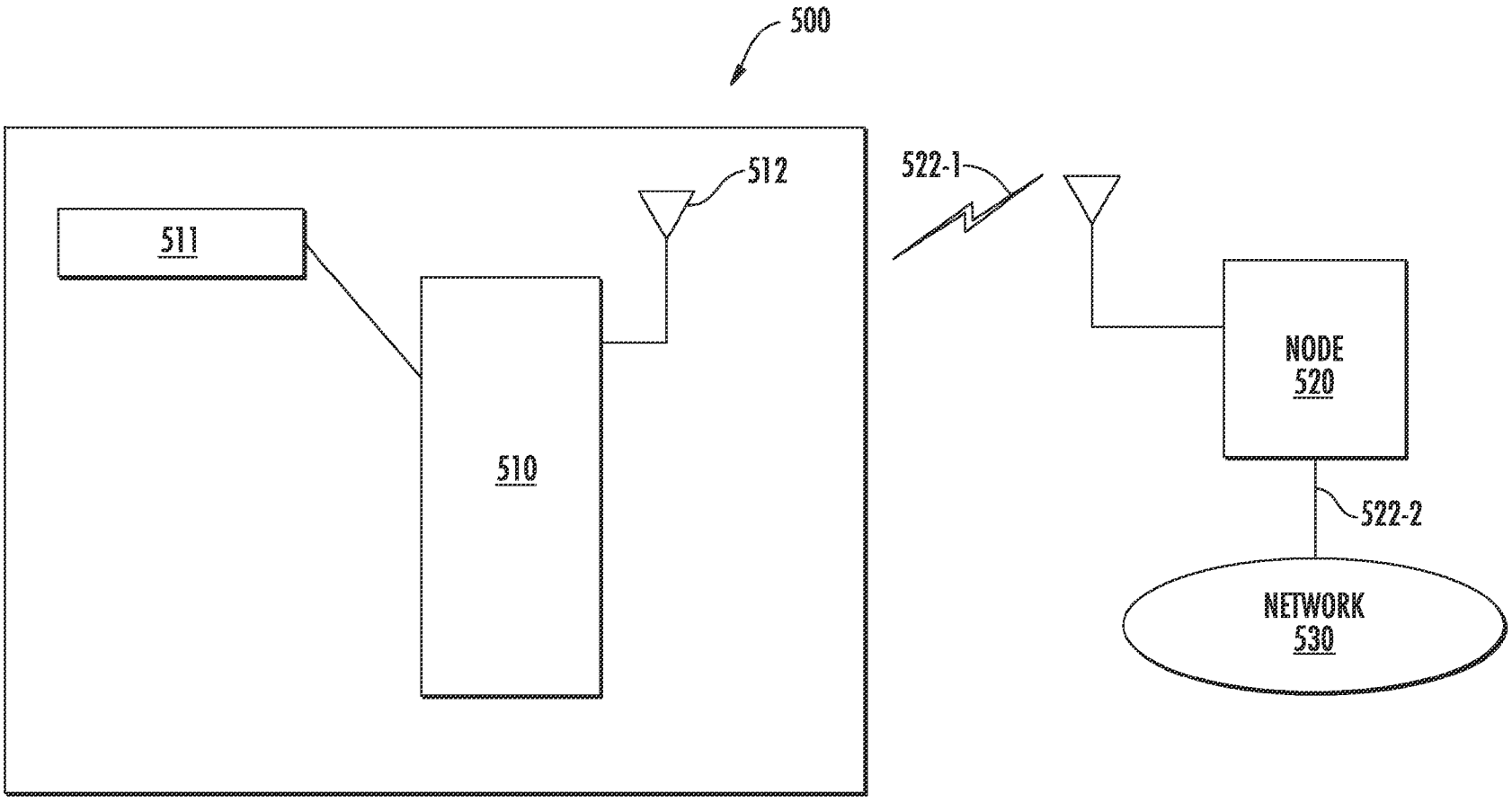
FIG. 12 illustrates a system in accordance with one or more embodiments.

FIG. 12 illustrates one embodiment of a communications system 500 having multiple nodes. A node may comprise any physical or logical entity for communicating information in the communications system 500 and may be implemented as hardware, software, or any combination thereof, as desired for a given set of design parameters or performance constraints. Although FIG. 12 is shown with a limited number of nodes in a certain topology, it may be appreciated that communications system 500 may include more or less nodes in any type of topology as desired for a given implementation. The embodiments are not limited in this context.

In various embodiments, a node may comprise a processing system, a computer system, a computer sub-system, a computer, a laptop computer, an ultra-laptop computer, a portable computer, a handheld computer, a PDA, a cellular telephone, a combination cellular telephone/PDA, a microprocessor, an integrated circuit, a PLD, a DSP, a processor, a circuit, a logic gate, a register, a microprocessor, an integrated circuit, a semiconductor device, a chip, a transistor, and so forth. The embodiments are not limited in this context.

In various embodiments, a node may comprise, or be implemented as, software, a software module, an application, a program, a subroutine, an instruction set, computing code, words, values, symbols or combination thereof. A node may be implemented according to a predefined computer language, manner or syntax, for instructing a processor to perform a certain function. Examples of a computer language may include C, C++, Java, BASIC, Perl, Matlab, Pascal, Visual BASIC, assembly language, machine code, microcode for a processor, and so forth. The embodiments are not limited in this context.

Communications system 500 may be implemented as a wired communication system, a wireless communication system, or a combination of both. Although system 500 may be illustrated using a particular communications media by way of example, it may be appreciated that the principles and techniques discussed herein may be implemented using any type of communication media and accompanying technology. The embodiments are not limited in this context.

When implemented as a wired system, for example, communications system 500 may include one or more nodes arranged to communicate information over one or more wired communications media. Examples of wired communications media may include a wire, cable, PCB, backplane, switch fabric, semiconductor material, twisted-pair wire, co-axial cable, fiber optics, and so forth. The communications media may be connected to a node using an I/O adapter. The I/O adapter may be arranged to operate with any suitable technique for controlling information signals between nodes using a desired set of communications protocols, services or operating procedures. The I/O adapter may also include the appropriate physical connectors to connect the I/O adapter with a corresponding communications medium. Examples of an I/O adapter may include a network interface, a network interface card (NIC), disc controller, video controller, audio controller, and so forth. The embodiments are not limited in this context.

When implemented as a wireless system, for example, system 500 may include one or more wireless nodes arranged to communicate information over one or more types of wireless communication media, sometimes referred to herein as wireless shared media. An example of a wireless communication media may include portions of a wireless spectrum, such as the radio-frequency (RF) spectrum. The wireless nodes may include components and interfaces suitable for communicating information signals over the designated wireless spectrum, such as one or more antennas, wireless transceivers, amplifiers, filters, control logic, and so forth. As used herein, the term "transceiver" may be used in a very general sense to include a transmitter, a receiver, or a combination of both. The embodiments are not limited in this context.

As shown, the communications system 500 may include a wireless node 510. In various embodiments, the wireless node 510 may be implemented as a wireless device such as wireless device 100. Examples of wireless node 510 also may include any of the previous examples for a node as previously described.

In one embodiment, for example, the wireless node 510 may comprise a receiver 511 and an antenna 512. The receiver 511 may be implemented, for example, by any suitable receiver for receiving electrical energy in accordance with a given set of performance or design constraints as desired for a particular implementation. In various embodiments, the antenna 512 may be similar in structure and operation the antenna structures 108, 208, 208, 408 described in relation to FIGS. 1-11. In some implementations, the antenna 512 may be configured for reception as well as transmission.

In various embodiments, the communications system 500 may include a wireless node 520. Wireless node 520 may comprise, for example, a mobile station or fixed station having wireless capabilities. Examples for wireless node 520 may include any of the examples given for wireless node 510, and further including a wireless access point, base station or node B, router, switch, hub, gateway, and so forth. In one embodiment, for example, wireless node 520 may comprise a base station for a cellular radiotelephone communications system. Although some embodiments may be described with wireless node 520 implemented as a base station by way of example, it may be appreciated that other embodiments may be implemented using other wireless devices as well. The embodiments are not limited in this context.

Communications between the wireless nodes 510, 520 may be performed over wireless shared media 522-1 in accordance with a number of wireless protocols. Examples of wireless protocols may include various wireless local area network (WLAN) protocols, including the Institute of Electrical and Electronics Engineers (IEEE) 802.xx series of protocols, such as IEEE 802.11a/b/g/n, IEEE 802.16, IEEE 802.20, and so forth. Other examples of wireless protocols may include various WWAN protocols, such as GSM cellular radiotelephone system protocols with GPRS, CDMA cellular radiotelephone communication systems with 1xRTT, EDGE systems, EV-DO systems, EV-DV systems, HSDPA systems, and so forth. Further examples of wireless protocols may include wireless personal area network (PAN) protocols, such as an Infrared protocol, a protocol from the Bluetooth Special Interest Group (SIG) series of protocols, including Bluetooth Specification versions v1.0, v1.1, v1.2, v2.0, v2.0 with Enhanced Data Rate (EDR), as well as one or more Bluetooth Profiles, and so forth. Yet another example of wireless protocols may include near-field communication techniques and protocols, such as electromagnetic induction (EMI) techniques. An example of EMI techniques may include passive or active radio-frequency identification (RFID) protocols and devices. Other suitable protocols may include Ultra Wide Band (UWB), Digital Office (DO), Digital Home, Trusted Platform Module (TPM), ZigBee, and other protocols. The embodiments are not limited in this context.

In one embodiment, wireless nodes 510, 520 may comprise part of a cellular communication system. Examples of cellular communication systems may include Code Division Multiple Access (CDMA) cellular radiotelephone communication systems, Global System for Mobile Communications (GSM) cellular radiotelephone systems, North American Digital Cellular (NADC) cellular radiotelephone systems, Time Division Multiple Access (TDMA) cellular radiotelephone systems, Extended-TDMA (E-TDMA) cellular radiotelephone systems, Narrowband Advanced Mobile Phone Service (NAMPS) cellular radiotelephone systems, third generation (3G) systems such as Wide-band CDMA (WCDMA), CDMA-2000, Universal Mobile Telephone System (UMTS) cellular radiotelephone systems compliant with the Third-Generation Partnership Project (3GPP), and so forth. The embodiments are not limited in this context.

In addition to voice communication services, the wireless nodes 510, 520 may be arranged to communicate using a number of different wireless wide area network (WWAN) data communication services. Examples of cellular data communication systems offering WWAN data communication services may include a GSM with General Packet Radio Service (GPRS) systems (GSM/GPRS), CDMA/1xRTT systems, Enhanced Data Rates for Global Evolution (EDGE) systems, Evolution Data Only or EVDO systems, Evolution for Data and Voice (EV-DV) systems, High Speed Downlink Packet Access (HSDPA) systems, and so forth. The embodiments are not limited in this respect.

In one embodiment, the communication system 500 may include a network 530 connected to the wireless node 520 by wired communications medium 522-2. The network 530 may comprise additional nodes and connections to other networks, including a voice/data network such as the Public Switched Telephone Network (PSTN), a packet network such as the Internet, a local area network (LAN), a metropolitan area network (MAN), a wide area network (WAN), an enterprise network, a private network, and so forth. The network 530 also may include other cellular radio telephone system equipment, such as base stations, mobile subscriber centers, central offices, and so forth. The embodiments are not limited in this context.

Numerous specific details have been set forth to provide a thorough understanding of the embodiments. It will be understood, however, that the embodiments may be practiced without these specific details. In other instances, well-known operations, components and circuits have not been described in detail so as not to obscure the embodiments. It can be appreciated that the specific structural and functional details are representative and do not necessarily limit the scope of the embodiments.

Various embodiments may comprise one or more elements. An element may comprise any structure arranged to perform certain operations. Each element may be implemented as hardware, software, or any combination thereof, as desired for a given set of design and/or performance constraints. Although an embodiment may be described with a limited number of elements in a certain topology by way of example, the embodiment may include more or less elements in alternate topologies as desired for a given implementation.

Any reference to "one embodiment" or "an embodiment" means that a particular feature, structure, or characteristic described in connection with the embodiment is included in at least one embodiment. The appearances of the phrase "in one embodiment" in the specification are not necessarily all referring to the same embodiment.

Although some embodiments may be illustrated and described as comprising exemplary functional components or modules performing various operations, it can be appreciated that such components or modules may be implemented by one or more hardware components, software components, and/or combination thereof. The functional components and/or modules may be implemented, for example, by logic (e.g., instructions, data, and/or code) to be executed by a logic device (e.g., processor). Such logic may be stored internally or externally to a logic device on one or more types of computer-readable storage media.

It also is to be appreciated that the described embodiments illustrate exemplary implementations, and that the functional components and/or modules may be implemented in various other ways which are consistent with the described embodiments. Furthermore, the operations performed by such components or modules may be combined and/or separated for a given implementation and may be performed by a greater number or fewer number of components or modules.

Unless specifically stated otherwise, it may be appreciated that terms such as "processing," "computing," "calculating," "determining," or the like, refer to the action and/or processes of a computer or computing system, or similar electronic computing device, that manipulates and/or transforms data represented as physical quantities (e.g., electronic) within registers and/or memories into other data similarly represented as physical quantities within the memories, registers or other such information storage, transmission or display devices.

Some embodiments may be described using the expression "coupled" and "connected" along with their derivatives. These terms are not intended as synonyms for each other. For example, some embodiments may be described using the terms "connected" and/or "coupled" to indicate that two or more elements are in direct physical or electrical contact with each other. The term "coupled," however, may also mean that two or more elements are not in direct contact with each other, but yet still co-operate or interact with each other. With respect to software elements, for example, the term "coupled" may refer to interfaces, message interfaces, API, exchanging messages, and so forth.

Some of the figures may include a flow diagram. Although such figures may include a particular logic flow, it can be appreciated that the logic flow merely provides an exemplary implementation of the general functionality. Further, the logic flow does not necessarily have to be executed in the order presented unless otherwise indicated. In addition, the logic flow may be implemented by a hardware element, a software element executed by a processor, or any combination thereof.

While certain features of the embodiments have been illustrated as described above, many modifications, substitutions, changes and equivalents will now occur to those skilled in the art. It is therefore to be understood that the appended claims are intended to cover all such modifications and changes as fall within the true spirit of the embodiments.

The invention claimed is:

1. An antenna, comprising:

a first resonating element comprising first, second, third, and fourth sections:

the first section oriented perpendicular to a printed circuit board, the second section comprising a first end and a second end, the first end coupled to the first section, the second section oriented parallel to a top edge of the printed circuit board, the second section longer than each of the first and third linear sections, the third section comprising two ends, the first end coupled to the second end of the second section and the second end coupled to an end of the fourth section, the third section oriented perpendicular to the printed circuit board, the fourth section comprising a free end, the fourth section coupled to the third section and oriented parallel to the top edge of the printed circuit board, the fourth section longer than each of the first, second, and third sections;

a ground conductor;

a signal feed coupled to the first section of the first resonating element;

a second resonating element coupled to the first section of the first resonating element, the second resonating element having a first portion and a second portion, the first portion extending from the first resonating element in a first direction toward a first distal end of the second resonating element and perpendicular to the first section of the first resonating element, the second portion extending from the first resonating element in a second direction opposite the first direction and toward a second distal end of the second resonating element and perpendicular to the first section of the first resonating element, the first portion having a length that is unequal to a length of the second portion; and a third resonating element coupled to the ground conductor and comprising fifth and sixth sections, the fifth section oriented perpendicular to the printed circuit board, the sixth section coupled to a first end of the fifth section and oriented perpendicular to the fifth section.

2. The antenna of claim 1, the first portion being longer than the second portion.

3. The antenna of claim 2, the first portion coupled to the ground conductor via a ground leg.

4. The antenna of claim 1, the ground conductor comprising at least a portion of the printed circuit board.

5. The antenna of claim 1, the second portion positioned adjacent the third resonating element.

6. The antenna of claim 1, the antenna comprising an on-ground planar inverted-f antenna.

7. The antenna of claim 1, the second resonating element and third resonating element capable of producing at least four different resonances.

8. The antenna of claim 1, wherein the first portion generates a first resonance, the second resonating element capable of generating a second resonance, the second portion capable of generating a third resonance, and the third resonating element capable of generating a fourth resonance.

9. The antenna of claim 8, the first, second, third, and fourth resonances being different from each other.

10. The antenna of claim 1, the first resonating element comprising a low band arm, the second resonating element comprising an off-fed high band arm, and the third resonating element comprising a ground resonator.

11. A mobile computing device, comprising:

an applications processor, a radio processor, a display, and an antenna, the antenna comprising:

a first resonating element comprising first, second, third, and fourth sections:

the first section oriented perpendicular to a printed circuit board, the second section comprising a first end and a second end, the first end coupled to the first section, the second section oriented parallel to a top edge of the printed circuit board, the second section longer than each of the first and third sections, the third section comprising two ends, the first end coupled to the second end of the second section and the second end coupled to an end of the fourth section, the third section oriented perpendicular to the printed circuit board, the fourth section comprising a free end, the fourth section coupled to the third section and oriented parallel to the top edge of the printed circuit board, the fourth section longer than each of the first, second, and third sections;

a ground conductor;

a signal feed coupled to the first resonating element;

a second resonating element coupled to the first section of the first resonating element, the second resonating element having first and second portions of unequal length, the first and second portions extending from the first resonating element, the first portion extending in a first direction and perpendicular to the first section of the first resonating element and the second portion extending in a second direction opposite the first direction and perpendicular to the first section of the first resonating element; and a third resonating element coupled to the ground conductor and comprising fifth and sixth sections, the fifth section oriented perpendicular to the printed circuit board, the sixth section coupled to a first end of the fifth section and oriented perpendicular to the fifth section.

12. The device of claim 11, comprising a ground leg coupling the first portion to the ground conductor.

13. The device of claim 11, the first portion capable of generating a first resonance, the second resonating element capable of generating a second resonance, the second portion capable of generating a third resonance, and the third resonating element capable of generating a fourth resonance.

14. The device of claim 13, the first, second, third, and fourth resonances being different from each other.

15. The device of claim 11, the ground conductor comprising at least a portion of the printed circuit board.

16. The device of claim 11, the second portion positioned adjacent the third resonating element.

17. An antenna, comprising:

first, second and third resonating elements, the first resonating element electrically coupled to the second resonating element, the first resonating element comprising first, second, third, and fourth sections:

the first section oriented perpendicular to a printed circuit board, the second section comprising a first end and a second end, the first end coupled to the first section, the second section oriented parallel to a top edge of the printed circuit board, the second section longer than each of the first and third sections, the third section comprising two ends, the first end coupled to the second end of the second section and the second end coupled to an end of the fourth section, the third section oriented perpendicular to the printed circuit board, the fourth section comprising a free end, the fourth section coupled to the third section and oriented parallel to the top edge of the printed circuit board, the fourth section longer than each of the first, second, and third sections;

a ground conductor coupled to the third resonating element, the third resonating element comprising fifth and sixth sections, the fifth section oriented perpendicular to the printed circuit board, the sixth section coupled to a first end of the fifth section and oriented perpendicular to the fifth section; and a signal feed coupled to the first section of the first resonating element;

wherein the second resonating element is coupled to the first section of the first resonating element and has first and second portions, the first portion extending from the first resonating element and toward a first end of the second resonating element and perpendicular to the first section of the first resonating element, the second portion extending from the first resonating element and toward a second end of the second resonating element in a direction opposite the first portion and perpendicular to the first section of the first resonating element, the first and second portions being of unequal length.

18. The antenna of claim 17, comprising a ground leg coupling the first portion to the ground conductor.

19. The antenna of claim 17, the first portion capable of generating a first resonance, the second resonating element capable of generating a second resonance, the second portion capable of generating a third resonance, and the third resonating element capable of generating a fourth resonance.

20. The antenna of claim 19, the first, second, third, and fourth resonances being different from each other.

21. The antenna of claim 1, wherein the first resonating element is configured to define a volume, and wherein the second resonating element is at least partially disposed within the volume.

22. The antenna of claim 1, wherein the second resonating element is configured to be parallel with an edge of a printed circuit board, and wherein the first resonating element comprises two portions parallel with the second resonating element, and wherein the two portions of the first resonating element are joined by a third portion perpendicular to the two portions.

* * * * *